US012644239B2

(12) United States Patent
Huber et al.

(10) Patent No.: US 12,644,239 B2
(45) Date of Patent: Jun. 2, 2026

(54) FORMWORK SYSTEM AND METHOD

(71) Applicant: PERI SE, Weissenhorn (DE)

(72) Inventors: Julian Huber, Merklingen (DE); Andrew Read, Voehringen (DE); Florian Sturm, Unterroth (DE); Stefan Pfister, Guenzburg (DE)

(73) Assignee: PERI SE, Weissenhorn (DE)

( * ) Notice: Subject to any disclaimer, the term of this patent is extended or adjusted under 35 U.S.C. 154(b) by 777 days.

(21) Appl. No.: 18/067,265

(22) Filed: Dec. 16, 2022

(65) Prior Publication Data

US 2025/0290259 A1 Sep. 18, 2025

(51) Int. Cl.
*E01D 19/02* (2006.01)
*E01D 19/14* (2006.01)

(52) U.S. Cl.
CPC ..... *E01D 19/02* (2013.01); *E01D 19/14* (2013.01)

(58) Field of Classification Search
CPC ..... E01D 19/02; E01D 19/14; E01D 21/00
See application file for complete search history.

(56) References Cited

U.S. PATENT DOCUMENTS 2,855,654 A * 10/1958 Stroben ..... E01D 21/00 248/235
3,119,590 A * 1/1964 Eriksson ..... E04G 13/066 248/242
3,861,634 A * 1/1975 Hood ..... E04G 13/06 249/23
4,660,800 A * 4/1987 Horstketter ..... E04G 13/066 14/71.3
4,846,433 A * 7/1989 Courtois ..... E04G 17/18 249/23
5,134,741 A * 8/1992 Carcassi ..... E01D 2/04 425/65
5,755,981 A * 5/1998 Payne ..... E04G 13/066 249/23
8,522,381 B1 9/2013 Smith
2005/0071936 A1* 4/2005 Jackson ..... E01D 21/00 14/13
2011/0138549 A1* 6/2011 He ..... E01D 19/125 254/98
2012/0011665 A1* 1/2012 Porter ..... E01D 22/00 14/75
2014/0173903 A1 6/2014 Ley
2019/0106891 A1* 4/2019 Jackson ..... E04G 17/18
2019/0226165 A1* 7/2019 Jackson ..... E01D 21/00
2020/0131723 A1* 4/2020 Jackson ..... E01D 21/00
2020/0283971 A1* 9/2020 Roberts ..... E04G 13/066

FOREIGN PATENT DOCUMENTS

CN 201128880 Y 10/2008
CN 101368372 A 2/2009
CN 201245818 Y 5/2009
CN 201460205 U 5/2010
CN 201567533 U 9/2010
CN 101440604 B 1/2011
CN 101586329 B 2/2011
(Continued)

*Primary Examiner* — Abigail A Risic
(74) *Attorney, Agent, or Firm* — Jones Day

(57) ABSTRACT

A formwork system for a bridge pier configured to support loads associated with bridge pier construction with reduced, or being free of, anchors in the column.

20 Claims, 10 Drawing Sheets

(56) References Cited

FOREIGN PATENT DOCUMENTS

| | | | | |
|---|---|---|---|---|
| CN | 201762662 | U | | 3/2011 |
| CN | 201762663 | U | | 3/2011 |
| CN | 201943006 | U | | 8/2011 |
| CN | 201962605 | U | | 9/2011 |
| CN | 102234982 | A | | 11/2011 |
| CN | 102296542 | A | | 12/2011 |
| CN | 202144582 | U | | 2/2012 |
| CN | 202148494 | U | | 2/2012 |
| CN | 102051858 | B | | 5/2012 |
| CN | 102628253 | A | | 8/2012 |
| CN | 202359506 | U | | 8/2012 |
| CN | 202509404 | U | | 10/2012 |
| CN | 202543806 | U | | 11/2012 |
| CN | 102286925 | B | | 1/2013 |
| CN | 202766974 | U | | 3/2013 |
| CN | 203188589 | U | | 9/2013 |
| CN | 102433845 | B | | 12/2013 |
| CN | 103866692 | A | | 6/2014 |
| CN | 203729206 | U | | 7/2014 |
| CN | 102505636 | B | | 9/2014 |
| CN | 203923914 | U | | 11/2014 |
| CN | 104233961 | A | * | 12/2014 |
| CN | 204080649 | U | | 1/2015 |
| CN | 204112234 | U | | 1/2015 |
| CN | 104532758 | A | | 4/2015 |
| CN | 103696373 | B | | 6/2015 |
| CN | 103452049 | B | | 8/2015 |
| CN | 204589822 | U | | 8/2015 |
| CN | 204825652 | U | | 12/2015 |
| CN | 204919346 | U | | 12/2015 |
| CN | 105239510 | A | | 1/2016 |
| CN | 204982673 | U | | 1/2016 |
| CN | 104452598 | B | | 5/2016 |
| CN | 205205694 | U | | 5/2016 |
| CN | 103628416 | B | | 6/2016 |
| CN | 104328737 | B | | 6/2016 |
| CN | 205443958 | U | | 8/2016 |
| CN | 104233961 | B | | 9/2016 |
| CN | 205604088 | U | | 9/2016 |
| CN | 106351129 | A | | 1/2017 |
| CN | 205954498 | U | | 2/2017 |
| CN | 105178197 | B | | 4/2017 |
| CN | 105484164 | B | | 5/2017 |
| CN | 106638314 | A | | 5/2017 |
| CN | 105803946 | B | | 8/2017 |
| CN | 107100076 | A | | 8/2017 |
| CN | 107100083 | A | | 8/2017 |
| CN | 206815197 | U | | 12/2017 |
| CN | 107653781 | A | | 2/2018 |
| CN | 207143755 | U | | 3/2018 |
| CN | 108411790 | A | | 8/2018 |
| CN | 106638321 | B | | 11/2018 |
| CN | 108842623 | A | | 11/2018 |
| CN | 107542037 | B | | 12/2018 |
| CN | 108978482 | A | | 12/2018 |
| CN | 109267487 | A | | 1/2019 |
| CN | 208379444 | U | | 1/2019 |
| CN | 208501518 | U | | 2/2019 |
| CN | 109468953 | A | | 3/2019 |
| CN | 208884362 | U | | 5/2019 |
| CN | 208981155 | U | | 6/2019 |
| CN | 209024976 | U | | 6/2019 |
| CN | 109989347 | A | | 7/2019 |
| CN | 209114332 | U | | 7/2019 |
| CN | 209194353 | U | | 8/2019 |
| CN | 209194359 | U | | 8/2019 |
| CN | 209307862 | U | | 8/2019 |
| CN | 110318343 | A | | 10/2019 |
| CN | 209584871 | U | | 11/2019 |
| CN | 209636654 | U | | 11/2019 |
| CN | 110552502 | A | | 12/2019 |
| CN | 110565540 | A | | 12/2019 |
| CN | 110607750 | A | | 12/2019 |
| CN | 209816665 | U | | 12/2019 |
| CN | 209816675 | U | | 12/2019 |
| CN | 110644371 | A | | 1/2020 |
| CN | 110685222 | A | | 1/2020 |
| CN | 210013134 | U | | 2/2020 |
| CN | 210066507 | U | | 2/2020 |
| CN | 210134358 | U | | 3/2020 |
| CN | 111088760 | A | | 5/2020 |
| CN | 111155438 | A | | 5/2020 |
| CN | 210458985 | U | | 5/2020 |
| CN | 210561734 | U | | 5/2020 |
| CN | 211036680 | U | | 7/2020 |
| CN | 211057595 | U | | 7/2020 |
| CN | 211142827 | U | | 7/2020 |
| CN | 211522898 | U | | 9/2020 |
| CN | 211596456 | U | | 9/2020 |
| CN | 111778868 | A | | 10/2020 |
| CN | 111827116 | A | | 10/2020 |
| CN | 211689923 | U | | 10/2020 |
| CN | 112144411 | A | | 12/2020 |
| CN | 212175490 | U | | 12/2020 |
| CN | 110067203 | B | | 1/2021 |
| CN | 212358032 | U | | 1/2021 |
| CN | 212426758 | U | | 1/2021 |
| CN | 109024298 | B | | 2/2021 |
| CN | 212612024 | U | | 2/2021 |
| CN | 212612042 | U | | 2/2021 |
| CN | 212612043 | U | | 2/2021 |
| CN | 212612044 | U | | 2/2021 |
| CN | 213142800 | U | | 5/2021 |
| CN | 213296084 | U | | 5/2021 |
| CN | 111321674 | B | | 7/2021 |
| CN | 213709209 | U | | 7/2021 |
| CN | 213740607 | U | | 7/2021 |
| CN | 213740608 | U | | 7/2021 |
| CN | 213740609 | U | | 7/2021 |
| CN | 113235442 | A | | 8/2021 |
| CN | 214005438 | U | | 8/2021 |
| CN | 214168783 | U | | 9/2021 |
| CN | 110528376 | B | | 10/2021 |
| CN | 214459656 | U | | 10/2021 |
| CN | 113585082 | A | | 11/2021 |
| CN | 215104786 | U | | 12/2021 |
| CN | 215164707 | U | | 12/2021 |
| CN | 215164708 | U | | 12/2021 |
| CN | 215164709 | U | | 12/2021 |
| CN | 215366869 | U | | 12/2021 |
| CN | 113882277 | A | | 1/2022 |
| CN | 215482366 | U | | 1/2022 |
| CN | 114016421 | A | | 2/2022 |
| CN | 216194102 | U | | 4/2022 |
| CN | 113215996 | B | | 8/2022 |
| IN | 112227210 | B | | 3/2022 |
| JP | H09158470 | A | | 6/1997 |
| JP | H11158813 | A | | 6/1999 |
| JP | 4569878 | B2 | | 10/2010 |
| KR | 20110080499 | A | | 7/2011 |
| KR | 101198376 | B1 | | 11/2012 |
| KR | 101712430 | B1 | | 3/2017 |

* cited by examiner

FORMWORK SYSTEM AND METHOD

FIELD OF THE INVENTION

The invention relates to a formwork system for a bridge pier.

BACKGROUND OF THE INVENTION

In certain existing systems for constructing bridge pier caps, horizontal beams are typically anchored directly to the ground by steel cables and heavy concrete blocks. Alternatively, the beams can be anchored directly to a column. In the former, such configurations require bridge pier caps near the ground. For the latter, the anchor must be placed before concreting the column, which typically requires that such anchors are placed in a specific location, typically low on the column and visible from the ground, and must be closed or sealed after concreting processes are complete. Further, such a configuration presents difficulties during installation, such as bleeding of the concrete around the anchor point and limited flexibility to move the anchor points once concreted.

SUMMARY OF THE INVENTION

The present application overcomes the disadvantages of the prior art by providing a formwork system configured to support loads associated with bridge pier construction with reduced, or being free of, anchors in the column.

One aspect of the disclosure provides a formwork system, comprising: at least one beam configured to be positioned at a first height relative to a column; at least one transverse beam configured to be positioned at a second height below the first height and transverse to a longitudinal direction of the at least one beam; at least one strut coupled, directly or indirectly, to the at least one beam and coupled, directly or indirectly, to the at least one transverse beam; at least one rod coupled, directly or indirectly, to the at least one transverse beam.

In one example, the at least one rod is coupled, directly or indirectly, to the at least one beam such that a vertical load is transferred to the at least one beam via the at least one rod.

In one example, at least one bracing shoe configured to be positioned at a third height relative to the column, the at least one rod coupled, directly or indirectly, to the bracing shoe such that a vertical load is transferred to the column via the bracing shoe.

In one example, the system further includes a holding element coupled to the beam; and a second transverse beam arranged transverse to the longitudinal axis of the at least one beam and coupled to the holding element, the at least one strut coupled to the second transverse beam.

In one example, the system further includes a spanner coupled indirectly to the strut, the spanner being configured to receive the at least one rod.

In one example, the at least one transverse beam comprises a plurality of transverse beams and further comprising a plurality of spindles coupled to the plurality of transverse beams.

In one example, the at least one strut is adjustable in length.

In one example, the at least one beam, the at least one transverse beam, the at least one rod, and the at least one strut define a generally triangular configuration.

In one example, the at least one strut comprises a plurality of struts and the at least one rod comprises a plurality of rods such that and each transverse beam is indirectly coupled to at least two of the plurality of struts and indirectly coupled to at least two of the plurality of rods.

Another aspect of the disclosure provides a formwork system, comprising: at least one beam configured to be positioned at a first height relative to a column; at least one transverse beam configured to be positioned at a second height relative to the column; at least one strut coupled, directly or indirectly, to the at least one beam and coupled, directly or indirectly, to the at least one transverse beam; at least one rod coupled, directly or indirectly, to the at least one transverse beam and a) coupled, directly or indirectly, to the at least one beam such that a vertical load is transferred to the at least one beam, or b) coupled, directly or indirectly, to the column such that a vertical load is transferred to the at least one column.

Another aspect of the disclosure provides a formwork system for a bridge pier, comprising: at least one beam configured to be positioned at a first height relative to a column of the bridge pier and configured to support pouring a cap of the bridge pier; at least one transverse beam configured to be positioned at a second height relative to the column; at least one strut coupled, directly or indirectly, to the at least one beam and coupled, directly or indirectly, to the at least one transverse beam; at least one rod coupled, directly or indirectly, to the at least one transverse beam.

In one example, the at least one transverse beam comprises a pair of transverse beams on opposite sides of the column.

In one example, the pair of transverse beams are coupled by a spindle.

Another aspect of the disclosure provides a formwork system, comprising: at least one beam configured to be positioned at a first height relative to a column; at least one transverse beam configured to be positioned at a second height below the first height and transverse to a longitudinal direction of the at least one beam; at least one strut coupled, directly or indirectly, to the at least one beam and coupled, directly or indirectly, to the at least one transverse beam; at least one prop coupled, directly or indirectly, to the at least one transverse beam.

BRIEF DESCRIPTION OF THE DRAWINGS

The invention description below refers to the accompanying drawings, of which.

DETAILED DESCRIPTION

Figure 1A:
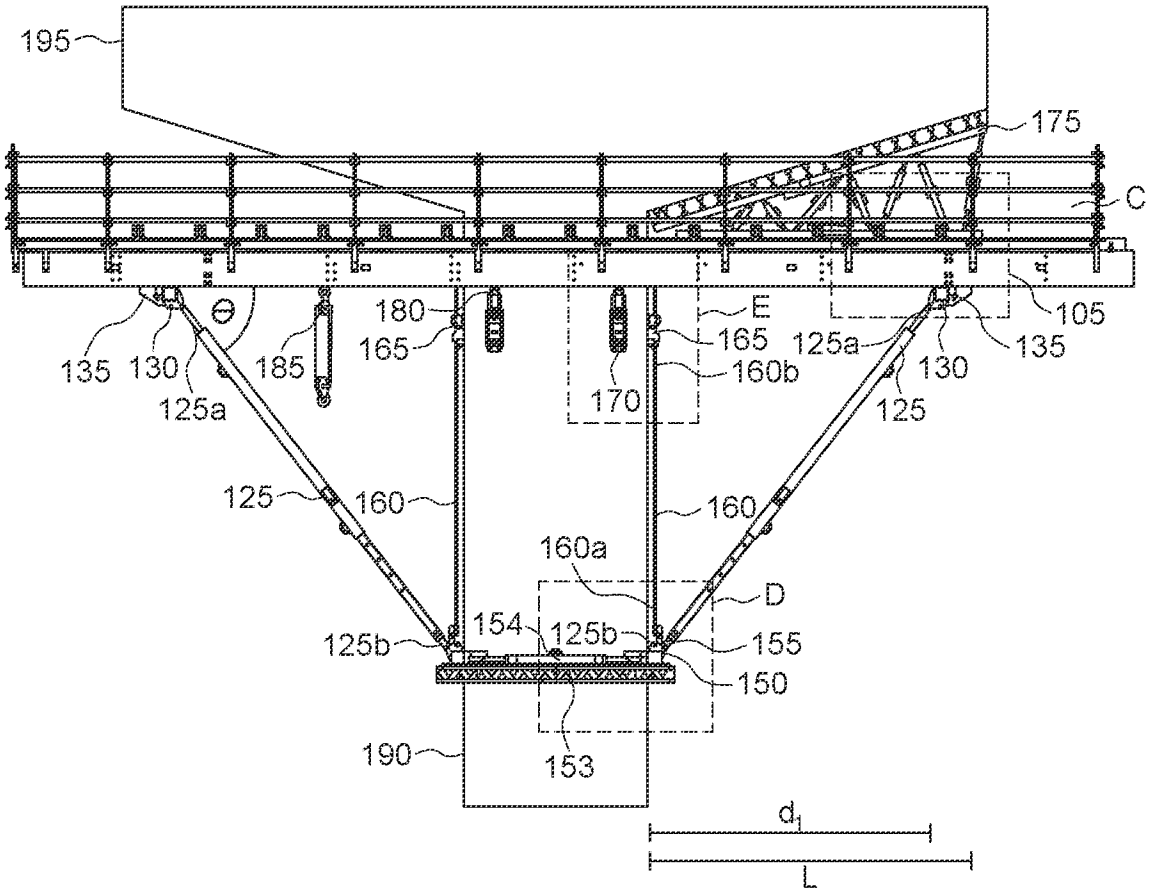
FIG. 1A is a side view of a formwork system according to one or more aspects of the disclosure.
Figure 1B:
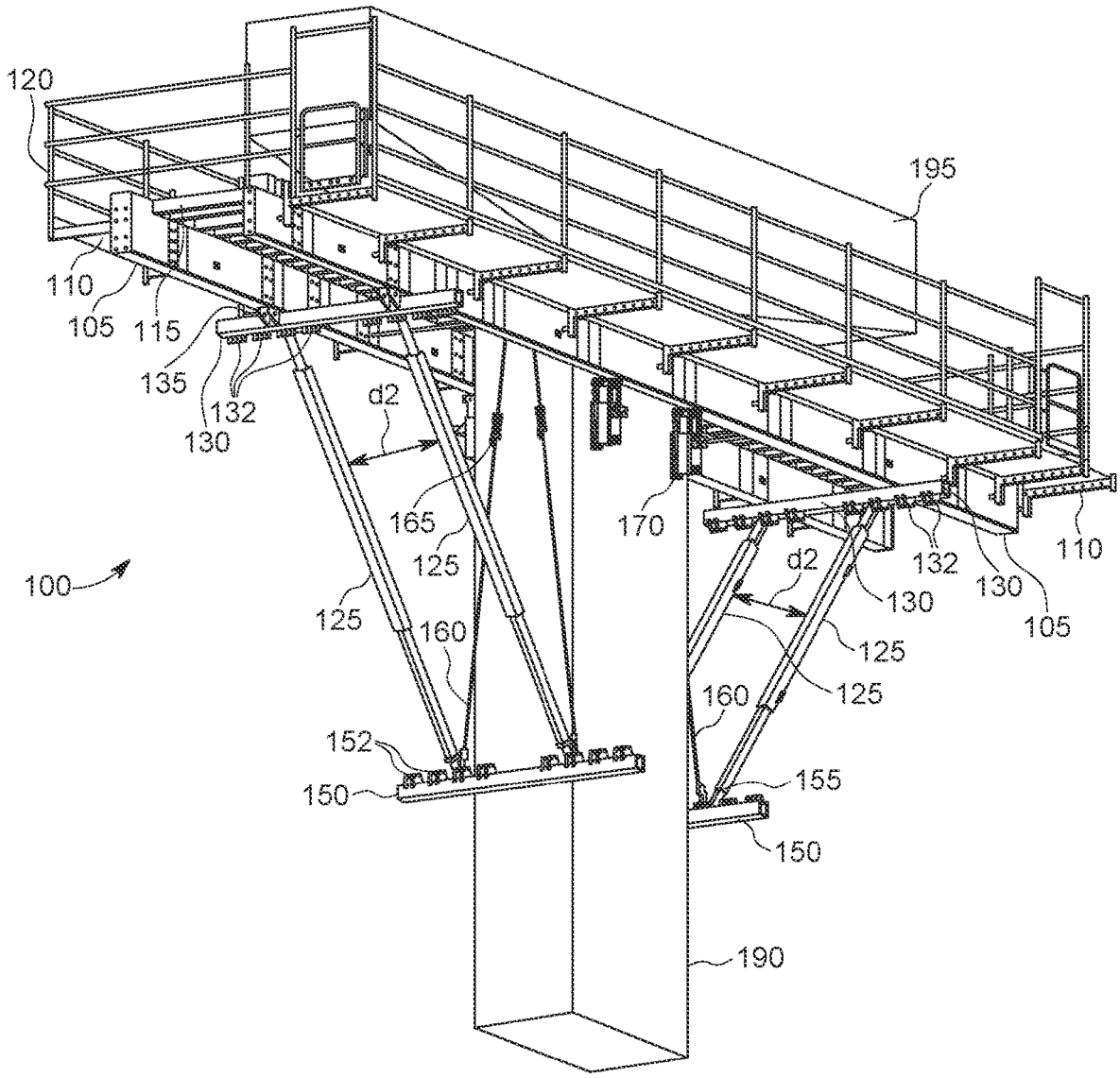
FIG. 1B is a perspective view of the formwork system according to one or more aspects of the disclosure.

FIG. 1A is a side view of a formwork system 100 and FIG. 1B is a perspective view of the formwork system 100 according to one or more aspects of the disclosure. As shown, the formwork system 100 is assembled relative to a column 190 for constructing (e.g., concreting) a cap 195, forming a bridge pier. In operation, the formwork system 100 may be assembled prior to pouring and drying of the cap 195, with the formwork system 100 being configured to support the loads associated with the pouring and drying of the cap 195. Once completed, the formwork system 100 may be stricken (e.g., removed) from the bridge pier and cycled (e.g., assembled) relative to another bridge pier for further construction operations.

The column 190 is depicted as having a square cross-sectional profile such that it has four sides. In other examples, the column 190 can have any type of 2D cross-sectional profile, such as a rectangle or circle. While the column 190 and cap 195 are depicted in the hammerhead configuration in FIG. 1A, the formwork system 100 of the present application can be implemented in any type of bridge pier construction.

The formwork system 100 can include at least one beam 105. As shown in FIG. 1B, the system 100 can include a pair of beams 105 oppositely arranged (e.g., positioned at opposite sides) relative to the column 190 such that the column 190 is arranged between the beams 105. The beams 105 can be any type of structural beam, and in one example can be a steel I-beam.

The beams 105 can be coupled with and support at least one working platform 110 to support a worker and/or equipment. The beams 105 can be coupled to and support at least one horizontal formwork element 115. In operation, the at least one horizontal formwork element 115 may be used to at least partially define a three-dimensional volume to receive poured concrete to form the cap 195. In other examples, additional formwork elements may be placed intermediate the horizontal formwork element 115 and the cap 195.

The system 100 can further include a guiderail 120 surrounding the working platform 110 and at least one jack 170 anchored to the column 190 to support beam 105. The at least one jack 170 can incorporate a tension belt 180 to control a position of the beam 105. The formwork system 100 can further include formwork elements 175 to support a surface of the cap 195 during pouring and drying, and/or additional formwork elements configured to create a volume for pouring concrete to form the cap 195 relative to the column 190. A related formwork system is described, for example, in U.S. Ser. No. 16/988,555 to Huber et al., filed Aug. 7, 2020, entitled FORMWORK SYSTEM AND METHOD, the entirety of which is herein incorporated by reference.

Figure 3A:
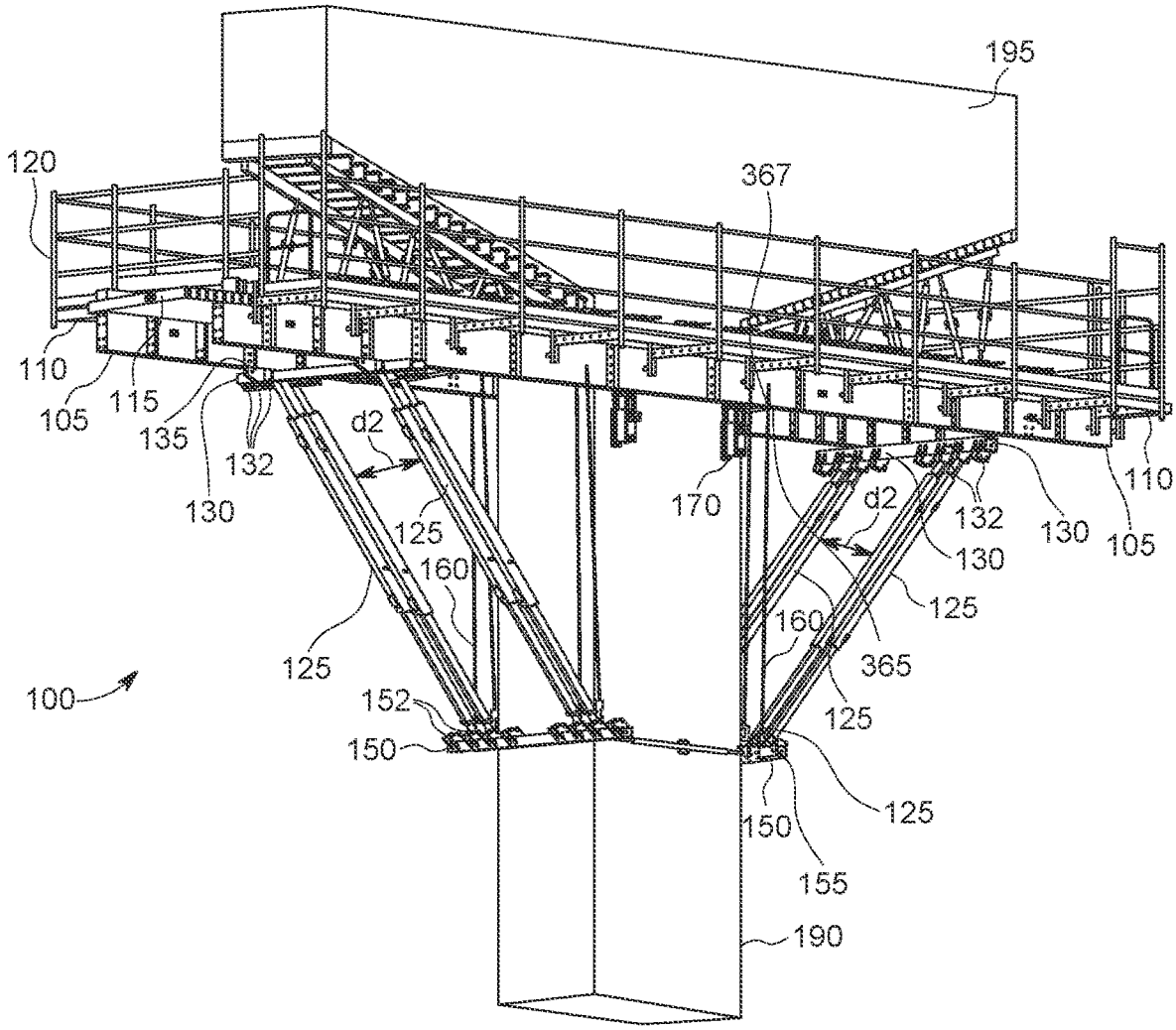
FIG. 3A is a perspective view of a formwork system according to one or more aspects of the disclosure.

To support the load of the cap 195 during pouring and drying, the formwork system 100 can include a plurality of struts 125 coupled, directly or indirectly, to the at least one beam 105. At least one strut of the first of the plurality of struts 125 can be coupled at a first side of the beam 105 and at least one strut of the plurality of struts 125 can coupled at a second side of the beam, with the second side of the beam 105 being opposite the first side of the beam 105 relative to the column 190. As shown in FIG. 1B, a pair of struts 125 may be positioned on one side of the column 190 and a second pair of struts 125 may be positioned on an opposing side of the column 190. In other examples, only one strut 125 or greater than two struts 125 may be implemented at each side (for example, FIG. 3A depicts four struts per side for a total of eight struts). The struts 125 can have an adjustable length to accommodate different site requirements. In one example, the struts 125 can be spindles such that actuation can cause the length to increase or decrease, e.g., lengthening or contraction. Such actuation can include manual actuation (e.g., rotating the spindle in a first direction to lengthen and a second direction to reduce the length). In other examples, the struts 125 can be actuated by a hydraulic system.

A distance $d_1$ between the coupling point of struts 125 to beam 105 and the column 190 can be less than a distance L from a surface of column 190 to an outer edge of cap 195. In another example, the distance $d_1$ can be greater than a distance L to accommodate additional load, such as load from concreting pressure or additional structures placed on the platform 110. In one particular example, the distance $d_1$ is approximately ⅔-¾ L. A distance $d_2$ between each respective pair of struts can be approximately a width of the column 190, while in other examples can be greater or less than the width.

As can be seen in FIGS. 1A-E and in particular FIG. 1A, the at least one beam 105, the at least one transverse beam 150, the at least one rod 160, and the at least one strut 125 define a generally triangular configuration.

The coupling of the one of the struts 125 to one of the beams 105 is depicted in section C of FIG. 1A and is shown and described in greater detail below with respect to FIG. 1C.

Figure 1C:
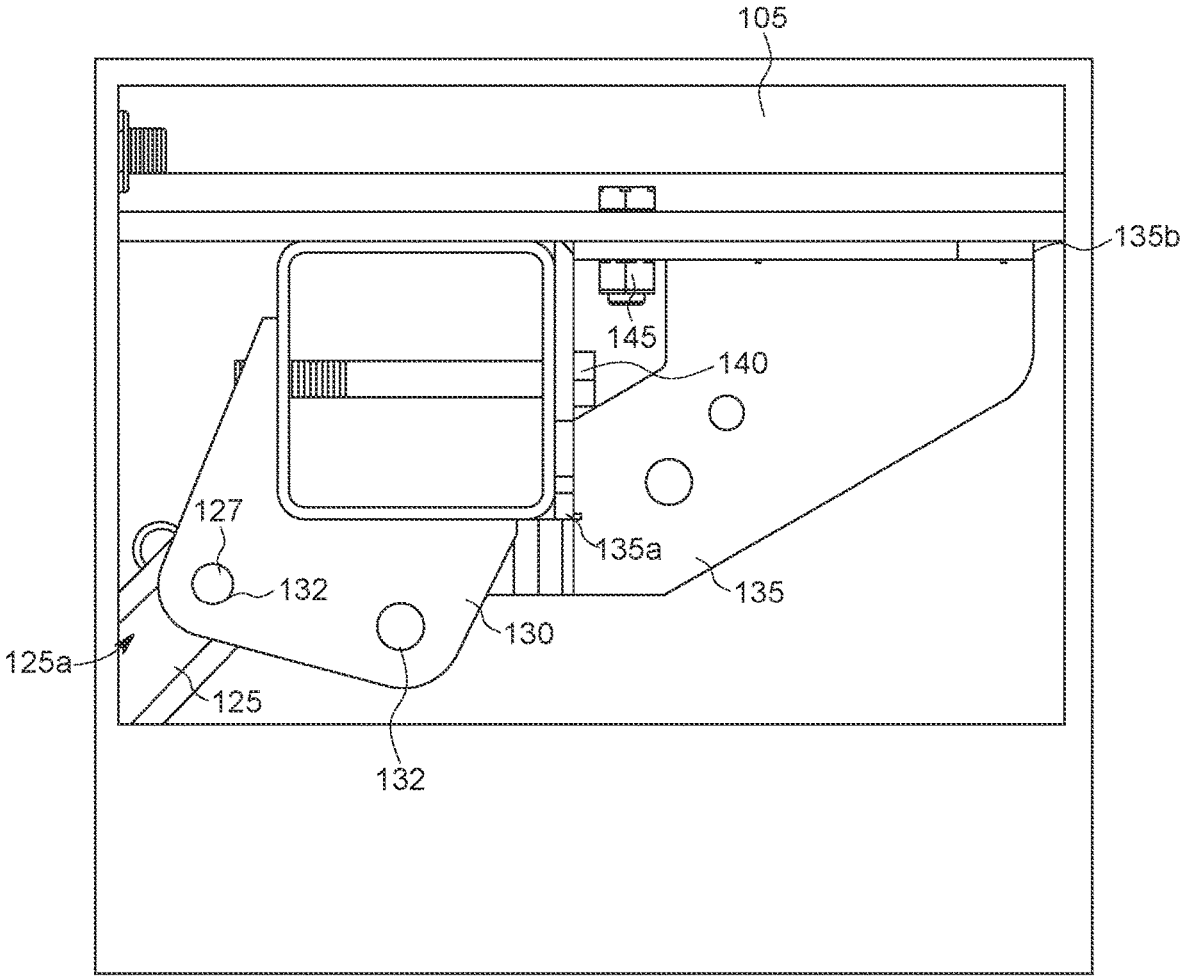
FIG. 1C is a detailed view of section C in FIG. 1A.

With reference to FIG. 1C, a first end 125*a* of one of the plurality of struts 125 can be coupled, directly or indirectly, to the beam 105. As shown, the strut 125 may be indirectly coupled to the beam 105 via one or more intermediate coupling elements (e.g., transverse beam 130 and/or holding element 135). In this example, the strut 125 is connected to a coupling point 132 of a transverse beam 130 via a pin 127. The transverse beam 130 can be a hollow structural steel beam having a substantially (e.g., rounded corners) square cross-sectional profile. In other examples, the cross-sectional profile can be any type of shape.

The transverse beam 130 can be coupled to a first support surface 135*a* of holding element 135 via bolt 140 and corresponding nut. The holding element 135 can include the first support surface 135*a* and a second support surface 135*b*, with the support surfaces 135*a-b* being arranged approximately perpendicular to one another, allowing for the transverse beam 130 to be positioned flush with beam 105. The second surface 135*b*, and thus the holding element 135, can be coupled to the beam 105 via bolt 145 and corresponding nut. In another example, the component 135 may be coupled (e.g., bolted) directly to the beam 105 and the struts 125 may be anchored directly against the ground.

While strut 125 is depicted as being indirectly coupled to beam 105 via transverse beam 130 and holding element 135, it is contemplated that other indirect or direct coupling arrangements can be implemented.

The plurality of struts 125 can extend at an angle θ relative to the beam 105 and can extend toward the column 190. In one example, the angle θ is between 30 and 60 degrees, and in one particular example the angle θ is approximately 45 degrees (e.g., 45 degrees +/−5 degrees). In any example, the angle can vary depending on the configuration and demands of the particular site. A length of the strut 125 can be adjustable to accommodate different worksite geometries. The length may be adjusted manually by actuating the strut 125, as described above.

A second end 125*b* of each of the struts 125 can couple, directly or indirectly, to a rod 160. In one example, the rod 160 can be a steel tie rod and can have threading along a portion, or an entirety, of a length of the rod 160. The coupling of the strut 125 to the rod 160 is depicted in section D and is shown and described in greater detail below with respect to FIG. 1D.

Figure 1D:
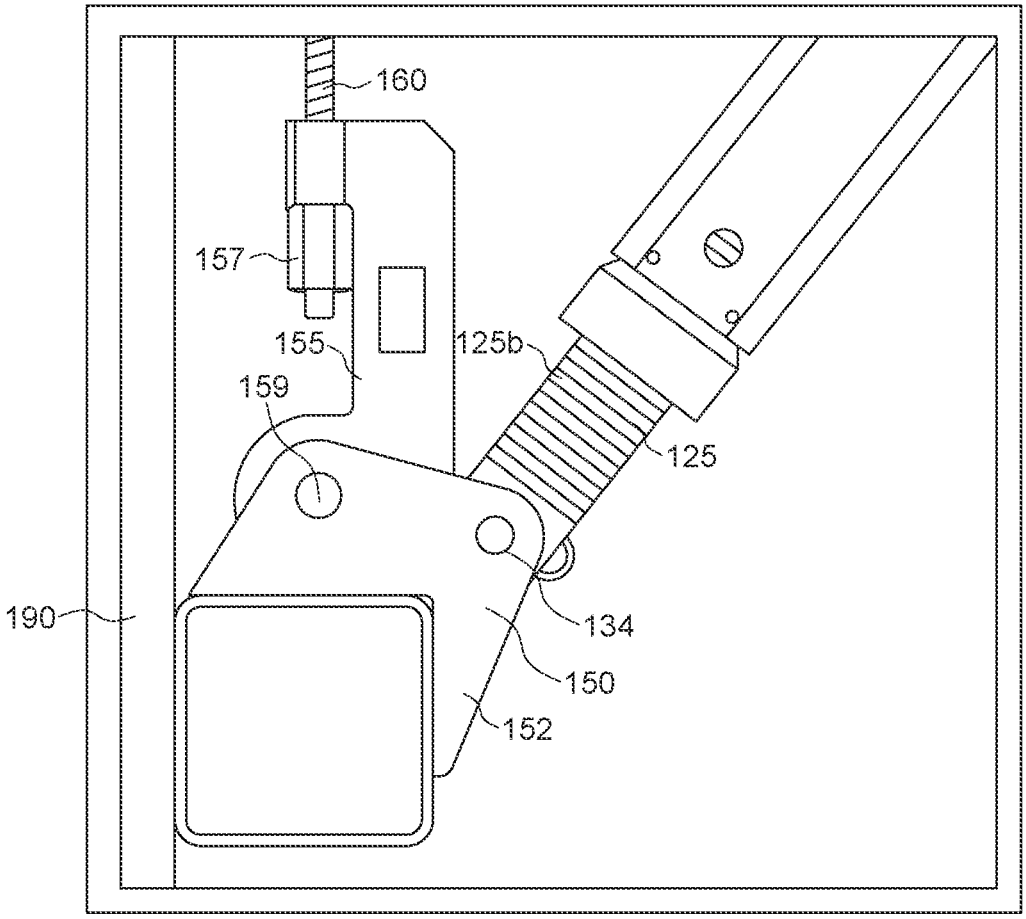
FIG. 1D is a detailed view of section D in FIG. 1A.

With reference to FIG. 1D, the second end 125*b* may be indirectly coupled to a first end 160*a* of the rod 160 via one or more intermediate coupling elements. As shown, a second end 125*b* of the strut 125 is connected to a coupling point 152 of a transverse beam 150 via a pin 134. The transverse beam 150 can be the same or similar to the transverse beam 130 described above. The transverse beam 150 is coupled to a spanner 155 via a pin 159 engagement with coupling point 152. The spanner 155 can receive a first end 160*a* of rod 160, which can be tightly secured relative to the spanner via nut 157. Optionally, the oppositely arranged transverse beams 150 can be coupled to one another by a strut or spindle 154.

While strut 125 is depicted as being indirectly coupled to rod 160 via transverse beam 150 and spanner 155, it is contemplated that other indirect or direct coupling arrangements can be implemented.

The transverse beam 150 directly abuts the column 190 (or indirectly abuts the column 190, e.g., via an intermediate piece of wood) and can be positioned at a height lower than a height where strut 125 couples with beam 105. As also shown, each of the strut 125, transverse beam 150, spanner 155, and rod 160 can be free of piercing or entering an exterior surface of the column 190. Stated another way, the strut 125, transverse beam 150, spanner 155, and/or rod 160 are not anchored to the column 190 via any type of embedded anchoring element. Advantageously, this eliminates the requirement that an anchoring point/element is embedded within the column before concreting the column 190 and preserves the structural integrity of the column 190.

Returning to FIGS. 1A-B, the rod 160 can extend vertically from the transverse beam 150 and the spanner 155 and toward the beam 105. A portion of the rod near the second end 160*b* can be coupled to bracing shoe 165. This is depicted in section E and is shown and described in greater detail below with respect to FIG. 1E.

Figure 1E:
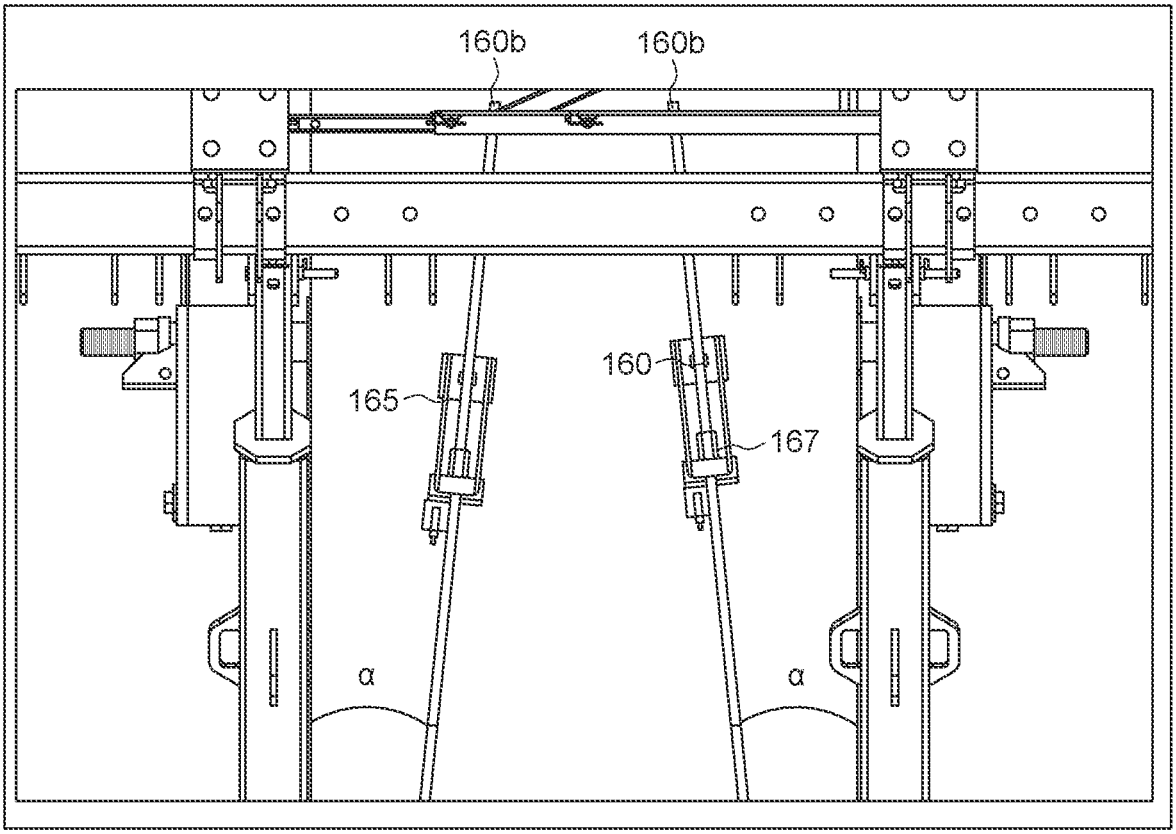
FIG. 1E is a detailed view of section E in FIG. 1A.

As shown in FIG. 1E, the plurality of bracing shoes 165 can be anchored (and/or freely removed or unanchored) to the column 190 at a height above the transverse beam 150. The rod 160 can be tightened and secured relative to bracing shoe 165 by a nut 167. The second end 160*b* may extend freely and upwardly beyond the bracing shoe 165. The rods 150 can be arranged at an angle $\alpha$ relative to the struts 125. In one example, the angle $\alpha$ can be less than 10 degrees.

Optionally, a pulley 185 can be used to raise and/or lower the transverse beam 150 and/or other elements of the formwork system 100, for example to raise the struts 125 relative to the column 190. Optionally, an auxiliary frame 153 can be positioned to hold spindle 154 relative to transverse beam 150 during assembly, but may be removed prior to a pouring operation.

Advantageously, the forces borne by the plurality of struts 125 are transferred to the column 190 and into the bracing shoes 165. For example, horizontal forces borne by the plurality of struts 125 are transferred horizontally into the concrete column 190 (via transverse beam 150), and the vertical forces borne by the plurality of struts 125 are transferred into rod 160 (via transverse beam 150 and spanner 155) and into bracing shoes 165 (in the example of FIG. 1A) and to beam 190 to which the bracing shoes 165 are attached.

The forces can advantageously be transferred without having to anchor the strut 125, transverse beam 150, spanner 155, and/or rod 160 within the column 190 (e.g., by embedding).

To assemble the formwork system 100, an auxiliary frame (e.g., auxiliary frame 153) may optionally be assembled at a predetermined height with respect to the column (e.g., column 190). The auxiliary frame 153 can be clamped relative to the column 190 using one or more rods.

The pair of transverse beams (e.g., transverse beams 150), including the coupling point 152 associated therewith, may be lifted onto the auxiliary frame 153 and arranged oppositely (e.g., on both sides of) relative to column 190 such that the transverse beams 150 are in full contact with the column 190. The pair of oppositely arranged transverse beams 150 can optionally be coupled by a plurality of spindles (e.g., spindle 154), which can ensure full contact with the column 190. In another example, the transverse beams 150 can be pre-assembled relative to the plurality of spindles and placed on the auxiliary frame 153 as a complete or partially completed assembly, and can be tightened relative to one another to ensure full contact with the column 190.

Next, if space between the ground and beam 105 permits, the transverse beam 130 (e.g., via holding element 135) and the plurality of struts 125 engaged therewith can be coupled to the beam 105. In another example, where space does not permit, the beam 105 may first be lifted and then the transverse beam 130 and the plurality of struts 125 can be coupled to the beam 105. In still another example, the beam 105 can be secured to the column 190 (e.g., onto jacks 170, and may be secured against unintentional uplifting via tension belt 180), and the transverse beam 130 and the plurality of struts 125 can be attached to the beam 105. In this regard, the transverse beam and plurality of struts can be provided by a crane, and a traverse extension can be used.

If the beam 105 is not yet lifted onto jacks 170 (e.g., in the examples where transverse beam 130 and plurality of struts 125 are engaged with beam 105 prior to lifting of beam 105 onto jacks 170), then the beam 105 (including platform, guardrail, etc.), transverse beam 130, and plurality of struts 125 are lifted and the beam 105 is lifted into jacks 170, with the beam 105 being secured to jacks 170 via a tension belt 180.

Then, the plurality of struts (e.g., struts 125), which are already engaged with the beam 105 via transverse beam 130, are coupled directly or indirectly to the transverse beam 150 using pulley 185. In this regard, the pulley 185 can support the plurality of struts while hanging vertically from the beam 105, and the pulley 185 can be used to maneuver the plurality of struts 125 toward the column 190 in order to engage the transverse beam 150.

Where applicable, the bracing shoes 165 can be assembled to the column 190 and the rods 160 can be assembled to the bracing shoes 165 and to the transverse beam 150 via spanner 155. In other examples, the rods 160 can be directly or indirectly to the beam 105 (e.g., in examples where bracing shoes are not used), as will be explained in greater detail below.

Figure 2A:
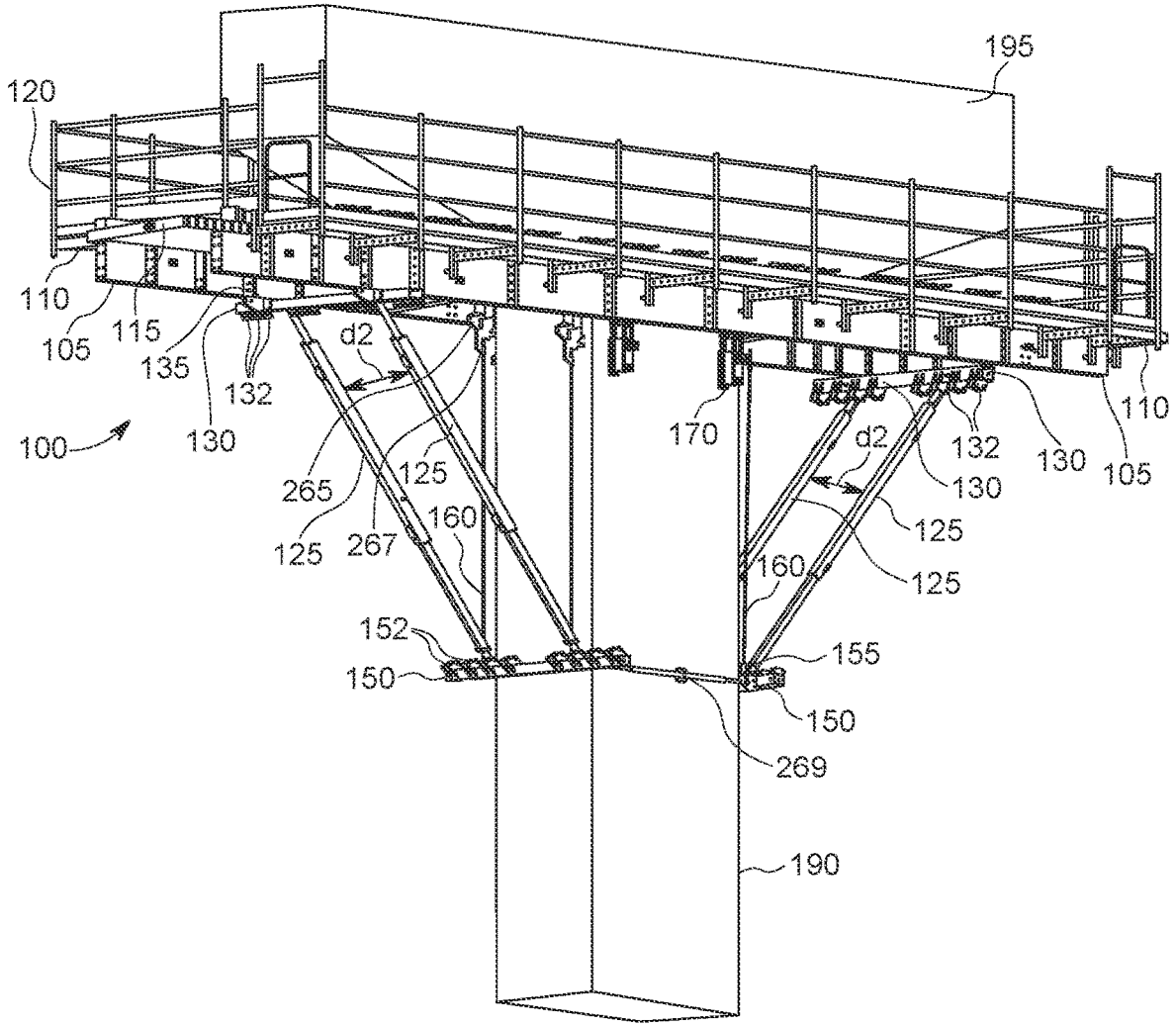
FIG. 2A is a perspective view of a formwork system according to one or more aspects of the disclosure.

FIG. 2A is a perspective view of a formwork system 200 according to one or more aspects of the disclosure.

In this example, the formwork system 200 is the same or similar as formwork system 100, except instead the system 200 does not include bracing shoes 165. Instead, the rod 160 extends vertically from spanner 155 and is coupled to the beam 105 via a holding element 265 and a spanner 267. The holding element 265 can be the same or similar as the holding element 135 and the spanner 267 can be the same or similar as the spanner 155.

Figure 2B:
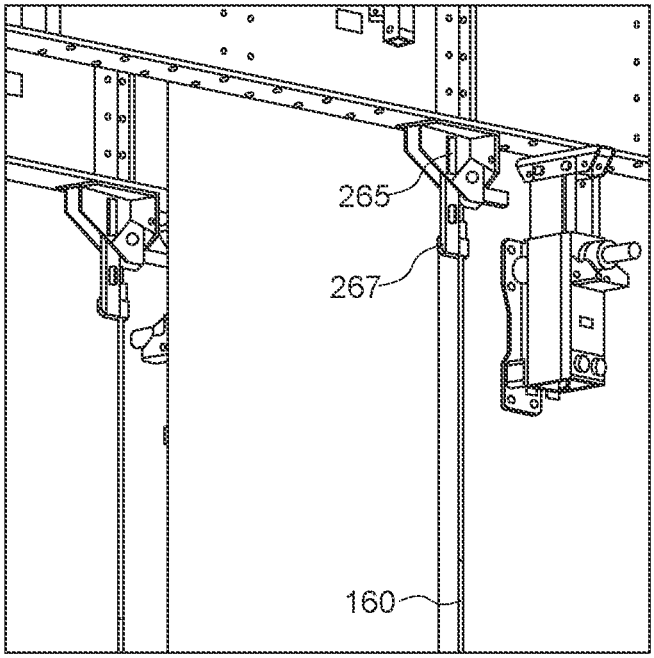
FIG. 2B is a partial view of the formwork system of FIG. 2A.

With reference to FIG. 2B, a second end 160*b* of the rod 160 can couple with a spanner 267 and the spanner 267 can couple with the holding element 265. The holding element 265 couples to the beam 105, allowing for distribution of vertical load from the struts 125 via rod 160.

Optionally, the system 200 may include a pair of spindles 269, each of which are connected to opposing transverse beams 150. The spindles 269 may couple the opposing transverse beams 150 in the example where the column 190 is narrow.

Advantageously, the forces borne by the plurality of struts 125 are transferred to the column 190 and into beam 105. For example, horizontal forces borne by the plurality of struts 125 are transferred horizontally into the concrete column 190 (via transverse beam 150), and the vertical forces borne by the plurality of struts 125 are transferred into rod 160 (via transverse beam 150 and spanner 155) and into beam 105 (in the example of FIG. 2A) via spanner 267 and holding element 265 and subsequently to column 190 via jacks 170 which support beam 105. This can be achieved without having to anchor the strut 125, transverse beam 150, spanner 155, and/or rod 160 within the column 190 (e.g., by embedding). Further advantageously, this example need not anchor bracing shoes 165 to the column 190. In some examples where the forces on jacks 170 exceeds or is estimated to exceed a maximum capacity of the jacks, the example of FIG. 1 may be implemented, which allows the vertical forces to be transferred directly to column 190. FIG. 3A is a perspective view of a formwork system 300 according to one or more aspects of the disclosure.

Figure 3B:
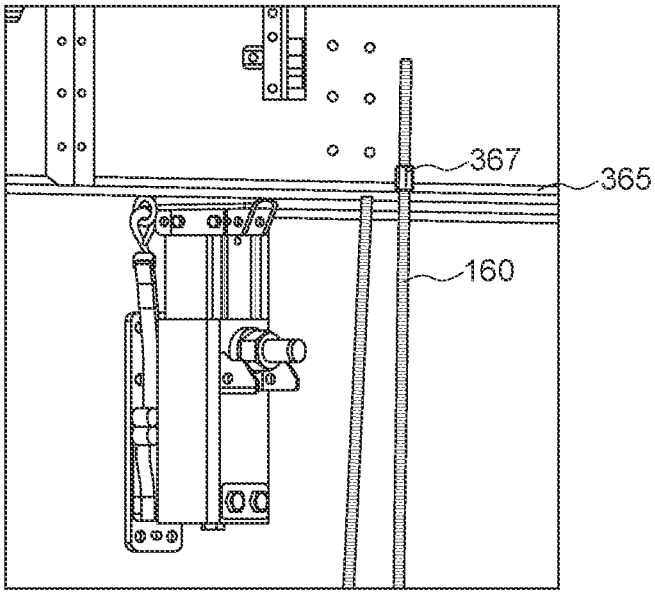
FIG. 3B is a partial view of the formwork system of FIG. 3A.

In this example, the formwork system 300 is the same or similar as formwork system 100, except instead the system 300 does not include bracing shoes 165 and includes additional struts 125, rods 160, and spanners 155. In this example, the plurality of rods 160 comprises eight rods 160 and the plurality of struts 125 comprises eight struts 125. In this regard, each of the rods 160 extend vertically and is received in a respective channel defined by a lip 365 in the beam 105. The rod 160 is tightened and secured to the beam 105 via a bolt 367. This is shown in more detail in FIG. 3B.

Figure 4:
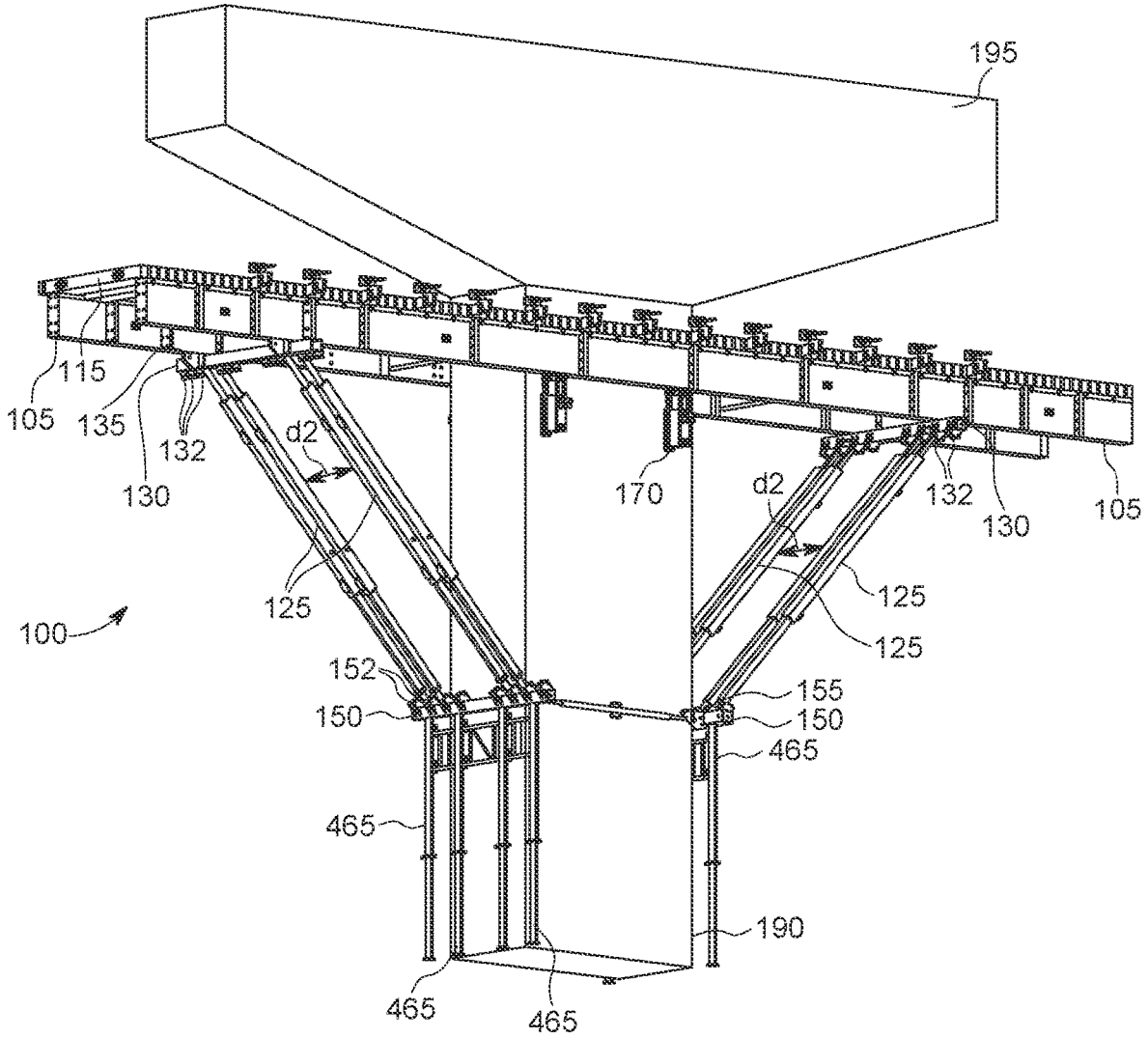
FIG. 4 is a perspective view of a formwork system according to one or more aspects of the disclosure.

Advantageously, the forces borne by the plurality of struts 125 are transferred to the column 190 and into the beam 105. For example, horizontal forces borne by the plurality of struts 125 are transferred horizontally into the concrete column 190 (via transverse beam 150), and the vertical forces borne by the plurality of struts 125 are transferred into rod 160 (via transverse beam 150 and spanner 155) and into beam 105 (in the example of FIG. 3A) via lip 365 and subsequently to column 190 via jacks 170 which support beam 105. This can be achieved without having to anchor the strut 125, transverse beam 150, spanner 155, and/or rod 160 within the column 190. Further advantageously, this example need not anchor bracing shoes 165 to the column 195. FIG. 4 is a perspective view of a formwork system 400 according to one or more aspects of the disclosure.

In this example, the formwork system 400 is the same or similar as formwork system 300, except instead the system 400 does not include any rods 160. Instead, the transverse beam 150 is engaged to and supported by one or more props 465 which can rest on the ground. The one or more props 465 can couple to the transverse beam 150 and provide vertical support to the transverse beam 150. In this example, the system 400 is free of any vertically extending rods (e.g., rod 150).

Advantageously, the forces borne by the plurality of struts 125 are transferred to the column 190 and into the ground. For example, horizontal forces borne by the plurality of struts 125 are transferred horizontally into the concrete column 190 (via transverse beam 150), and the vertical forces borne by the plurality of struts 125 are transferred into ground via props 465. This can be achieved without having to anchor the strut 125, transverse beam 150, spanner 155, and/or rod 160 within the column 190. Further advantageously, this example need not anchor bracing shoes 165 to the column 190.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A formwork system, comprising:

at least one beam configured to be positioned at a first height relative to a column;

at least one transverse beam configured to be positioned at a second height below the first height and transverse to a longitudinal direction of the at least one beam;

at least one strut coupled, directly or indirectly, to the at least one beam and coupled, directly or indirectly, to the at least one transverse beam; and at least one rod coupled, directly or indirectly, to the at least one transverse beam, wherein the at least one transverse beam and the at least one strut are configured such that at least a portion of the forces borne by the at least one strut are transferred to the column through contact, directly or indirectly, with a section of the column having no anchoring elements piercing an exterior surface of the column.

2. The system of claim 1, wherein the at least one rod is coupled, directly or indirectly, to the at least one beam such that a vertical load is transferred to the at least one beam via the at least one rod.

3. The system of claim 1, further comprising:

at least one bracing shoe configured to be positioned at a third height relative to the column, the at least one rod coupled, directly or indirectly, to the bracing shoe such that a vertical load is transferred to the column via the bracing shoe.

4. The system of claim 1, further comprising:

a holding element coupled to the beam; and a second transverse beam arranged transverse to the longitudinal axis of the at least one beam and coupled to the holding element, the at least one strut coupled to the second transverse beam.

5. The system of claim 1, further comprising:

a spanner coupled indirectly to the strut, the spanner being configured to receive the at least one rod.

6. The system of claim 1, wherein the at least one transverse beam comprises a plurality of transverse beams and further comprising a plurality of spindles coupled to the plurality of transverse beams.

7. The system of claim 1, wherein the at least one strut is adjustable in length.

8. The system of claim 1, wherein the at least one beam, the at least one transverse beam, the at least one rod, and the at least one strut define a generally triangular configuration.

9. The system of claim 1, wherein the at least one strut comprises a plurality of struts and the at least one rod comprises a plurality of rods such that and each transverse beam is indirectly coupled to at least two of the plurality of struts and indirectly coupled to at least two of the plurality of rods.

10. A formwork system, comprising:

at least one beam configured to be positioned at a first height relative to a column;

at least one transverse beam configured to be positioned at a second height relative to the column;

at least one strut coupled, directly or indirectly, to the at least one beam and coupled, directly or indirectly, to the at least one transverse beam; and at least one rod coupled, directly or indirectly, to the at least one transverse beam and a) coupled, directly or indirectly, to the at least one beam such that a vertical load is transferred to the at least one beam, or b) coupled, directly or indirectly, to the column such that a vertical load is transferred to the column, wherein the at least one transverse beam and the at least one strut are configured such that at least a portion of the forces borne by the at least one strut are transferred to the column through contact, directly or indirectly, with a section of the column having no anchoring elements piercing an exterior surface of the column.

11. A formwork system for a bridge pier, comprising:

at least one beam configured to be positioned at a first height relative to a column of the bridge pier and configured to support pouring a cap of the bridge pier;

at least one transverse beam configured to be positioned at a second height relative to the column;

at least one strut coupled, directly or indirectly, to the at least one beam and coupled, directly or indirectly, to the at least one transverse beam; and at least one rod coupled, directly or indirectly, to the at least one transverse beam, wherein the at least one transverse beam and the at least one strut are configured such that at least a portion of the forces borne by the at least one strut are transferred to the column through contact, directly or indirectly, with a section of the column having no anchoring elements piercing an exterior surface of the column.

12. The formwork system of claim 11, wherein the at least one transverse beam comprises a pair of transverse beams on opposite sides of the column.

13. The formwork system of claim 12, wherein the pair of transverse beams are coupled by a spindle.

14. A formwork system, comprising:

at least one beam configured to be positioned at a first height relative to a column;

at least one transverse beam configured to be positioned at a second height below the first height and transverse to a longitudinal direction of the at least one beam;

at least one strut coupled, directly or indirectly, to the at least one beam and coupled, directly or indirectly, to the at least one transverse beam; and at least one prop coupled, directly or indirectly, to the at least one transverse beam, wherein the at least one transverse beam, the at least one strut, and the at least one prop are configured such that at least a portion of the forces borne by the at least one strut are transferred to the column through contact, directly or indirectly, with a section of the column having no anchoring elements piercing an exterior surface of the column.

15. The system of claim 14, wherein the at least one transverse beam, the at least one strut, the at least one prop are configured such that the vertical forces borne by the at least one strut are transferred to the ground without any of the at least one transverse beam, the at least one strut, or the at least one prop being anchored, directly or indirectly, to the column.

16. The system of claim 14, wherein the at least one prop is substantially parallel to a vertical surface of the column.

17. The system of claim 14, wherein the at least one prop is directly coupled to the at least one transverse beam.

18. The system of claim 1, wherein the at least one transverse beam, the at least one strut, the at least one rod are configured such that the vertical forces borne by the at least one strut are transferred to the beam without any of the at least one transverse beam, the at least one strut, or the at least one rod being anchored, directly or indirectly, to the column.

19. The system of claim 1, wherein the at least one rod is substantially parallel to a vertical surface of the column.

20. The system of claim 1, wherein the at least one rod is directly coupled to the at least one transverse beam.

* * * * *